US006594830B2

(12) United States Patent
Geng

(10) Patent No.: US 6,594,830 B2
(45) Date of Patent: Jul. 22, 2003

(54) PROTECTIVE GLOVE LINER

(76) Inventor: Tony Geng, 36 Vimy Street, Acton, Ontario (CA), L7J 1S1

( * ) Notice: Subject to any disclaimer, the term of this patent is extended or adjusted under 35 U.S.C. 154(b) by 0 days.

(21) Appl. No.: 09/861,381

(22) Filed: May 18, 2001

(65) Prior Publication Data

US 2002/0073474 A1 Jun. 20, 2002

Related U.S. Application Data

(60) Provisional application No. 60/205,292, filed on May 19, 2000.

(51) Int. Cl.[7] ..... A41D 19/00
(52) U.S. Cl. ..... 2/164; 2/159
(58) Field of Search ..... 2/16, 20, 158, 2/159, 161.6, 161.7, 164, 166, 167, 169, 81, 97, 457, 458; 602/21, 22

(56) References Cited

U.S. PATENT DOCUMENTS

| | | | | | |
|---|---|---|---|---|---|
| 4,433,439 | A | | 2/1984 | Sidman et al. | 2/161 R |
| 4,454,611 | A | | 6/1984 | Tschirch et al. | 2/161 R |
| 4,662,006 | A | * | 5/1987 | Ross, Jr. | 2/158 |
| 4,849,280 | A | * | 7/1989 | Coombs | 442/247 |
| 4,918,756 | A | * | 4/1990 | Grilliot et al. | 2/159 |
| 4,937,136 | A | * | 6/1990 | Coombs | 442/247 |
| 5,236,769 | A | * | 8/1993 | Paire | 428/196 |
| 5,328,449 | A | * | 7/1994 | Andrews et al. | 2/161.7 |
| 5,349,705 | A | * | 9/1994 | Ragan | 2/161.6 |
| 5,598,582 | A | | 2/1997 | Andrews et al. | 2/16 |
| 5,822,796 | A | | 10/1998 | Harges, Jr. et al. | 2/161.6 |
| 6,021,523 | A | * | 2/2000 | Vero | 2/159 |
| 6,035,444 | A | | 3/2000 | McGrew | 2/161.6 |

FOREIGN PATENT DOCUMENTS

| | | | | |
|---|---|---|---|---|
| EP | 0 683 989 B1 | * | 7/1997 | A41D/19/00 |
| JP | 8-13212 | * | 8/1996 | A41D/19/00 |

* cited by examiner

*Primary Examiner*—Gary L. Welch
(74) *Attorney, Agent, or Firm*—Barley, Snyder, Senft & Cohen, LLC

(57) ABSTRACT

A glove liner which can be used in harsh environments to protect the user's hand from cuts and burns is disclosed. In so doing, the liners are made in two layers, with each layer performing a particular function. The inner layer is made from heat resistant material which will protect the user's hand from being burned in harsh environments. The outer layer is made from material which is cut resistant thereby preventing the user's hand from being cut or punctured and also preventing the heat resistant layer from being damaged. The liner is manufactured in such a manner as to provide the firefighter with maximum agility and mobility in his hand. The liner also protects the user in environments where the liner is not fully effective. In extremely harsh environments, it is conceivable that the user's hand may be burned. In such instances, the design of the liner allows the outer glove to be removed from the user's hand without damaging the skin of the user. The liner is maintained intact on the user's hand so that no skin will be removed by the removal of the liner. The liner is configured to allow the hand and the liner to be submersed in a solution until the user is transported to a hospital where proper medical procedures can be employed.

13 Claims, 1 Drawing Sheet

PROTECTIVE GLOVE LINER

This application claims the benefit of U.S. Provisional Application 60/205,292, filed May 19, 2000.

FIELD OF THE INVENTION

The present invention relates to glove liners which are formed of material resistant to heat and which provide protection against cutting or puncturing of the hand. More particularly, the present invention relates to glove liners for use by firefighters and industrial workers who come in contact with high temperatures.

BACKGROUND OF THE INVENTION

Protective gloves are well known in the art for protecting hands from adverse conditions. Many firefighters resort to conventional gloves to assist them in gripping articles and the like while relying on their gloves to protect their hands from injury. However, many conventional gloves are inadequate in conditions of high temperature. In order to provide more protection to the firefighters, various gloves have been devised which provide some means of heat protection and cut protection. One such glove is disclosed in U.S. Pat. No. 5,598,582 which provides a hand covering in the form of a glove which is waterproof and provides protection against cutting, puncturing, and lacerations as well as thermal insulation for protection against burning of the user's hand when grasping hot objects. A raised silicon pattern is formed on the palm portion of the glove to enhance the heat insulating and gripping abilities of the hand covering. Other such gloves are disclosed in U.S. Pat. Nos. 6,035,444 and 5,822,796.

Other types of protective hand covering are disclosed in U.S. Pat. Nos. 4,454,611 and 4,433,439. The 439 patent reveals a heat resistant protective glove having first and second shells formed from a temperature resistant aromatic polyamide fiber with the first shell section being made of a twill weave fabric and the second shell being made of a knitted fabric. A liner is formed of two sections, both of which are formed of a felt fabric of a temperature resistant aromatic polyamide fiber with the section forming the palm being provided with a flame resistant elastomeric coating. The 611 patent teaches of a heat resistant protective hand covering having a fabric shell made of a temperature resistant aromatic polyamide fiber. The outer surface of the shell is coated with a fire resistant elastomer. A liner made of felt fabric of a temperature resistant aromatic polyamide fiber is disposed within and secured to the shell. A friction inducing surface is formed by waffling or dimpling the palm side of the glove by incorporating small particles of insoluble material which will cause an irregular surface on a coating.

Each of these gloves is worn by the firefighter when fighting a fire. However, in order to provide the protection required by the firefighters, these gloves are generally made in such a way which restricts the firefighter's motion in his hands. As firefighters must be able to manipulate various objects in a burning building, the loss of mobility must be minimized.

SUMMARY OF THE INVENTION

The present invention is directed to a glove liner which can be used in harsh environments to protect the user's hand from cuts and burns. In so doing, the liners of the present invention are made in two layers, with each layer performing a particular function. The inner layer is made from heat resistant material which will protect the user's hand from being burned in harsh environments. The outer layer is made from material which is cut resistant thereby preventing the user's hand from being cut or punctured and also preventing the heat resistant layer from being damaged. The liner is manufactured in such a manner as to provide the firefighter with maximum agility and mobility in his hand. In other words, the liner does not prevent the firefighter or worker from performing any task required of him/her.

The liner also protects the user in environments where the liner is not fully effective. In extremely harsh environments, it is conceivable that the user's hand may be burned. In such instances, the design of the liner allows the outer glove to be removed from the user's hand without damaging the skin of the user. The liner is maintained intact on the user's hand so that no skin will be removed by the removal of the outer glove. The liner is configured to allow the hand and the liner to be submersed in a solution until the user is transported to a hospital where proper medical procedures can be employed.

BRIEF DESCRIPTION OF THE DRAWINGS

The present invention will be more fully understood by reference to the following drawing figures wherein.

DETAILED DESCRIPTION OF AN EMBODIMENT OF THE INVENTION

Figure 1:
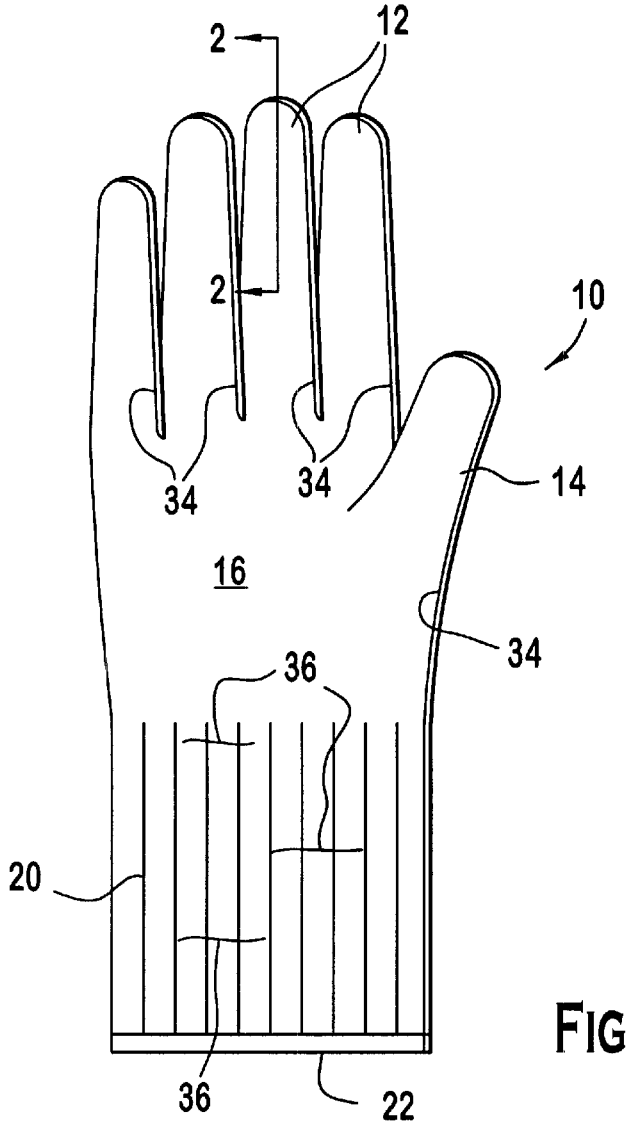
FIG. 1 is a front, elevational view of a glove liner constructed in accordance with the present invention.
Figure 2:
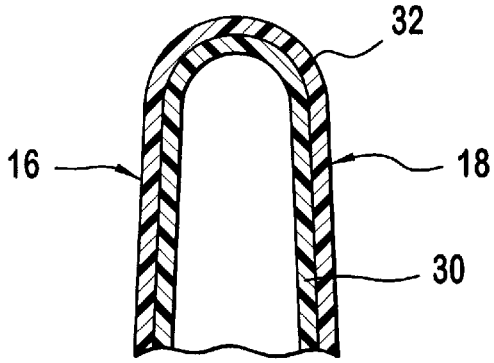
FIG. 2 is an enlarged cross-sectional view taken along line 2—2 of FIG. 1.

Referring to FIG. 1, a glove liner 10 has the typical fingerstalls 12 and thumbstall 14 which cooperates with a users hand when the user inserts his/her hand therein. The dimensioning of the liner is not particularly critical, as a liner which is larger than the hand of the user will still prove effective. The liner has a front side 16 which positioned proximate the palm of the user and a back side 18 which is positioned proximate the back of the hand of the user. In the embodiment shown, the liner is manufactured in such a manner that the front side and the back side are mirror images of each other. This allows the same glove to be worn on the right or left hand of the user, thereby allowing production costs to be minimized as different left and right gloves need not be manufactured. A wristlet 20 is provided as the base of the liner 10. The wristlet 20 has an opening 22 provided therethrough. The opening configured to allow the hand and the wrist of the user to be inserted into the liner 10. The wristlet is constructed to be elastic, thereby allowing the wristlet to cooperate with the wrist of the user to hold the liner in place, as is generally done in the glove industry. The length of the wristlet is designed to extend well up the forearm of the fire fighter to provide increased protection to the wrist and forearm of the fire fighter.

Liner 10 is made utilizing an inner shell 30 and an outer shell 32. The inner shell 30 is the shell that is closest to the user's hand when the hand is inserted into the liner. This inner shell is made from NOMEX that is manufactured by DuPont or other aromatic polyamide fibers which have the desired temperature and flame resistant characteristics needed. The particular weight of the material may vary, but an acceptable weight for a small glove is 0.240 grams, for a medium glove is 0.252 grams, and for a large glove is 0.264 grams. The particular weight of the material is chosen to provide the protective characteristics required, while insuring that the shell is lightweight and flexible. While the entire inner shell is made from the same material, the stitching in the wristlet 20 is different than the stitching found in the front and back sides 16, 18 of the liner 10. As previously mentioned, the stitching in the wristlet 20 allows for the elastic characteristics desired.

The outer shell 32 is the shell that is furthest from the user's hand when the hand is inserted into the liner. This outer shell is made from puncture and cut resistant material such as KEVLAR which is manufactured by DuPont or other aromatic polyamide fibers which have the desired strength and mechanical integrity characteristics needed. The particular weight of the material may vary, but an acceptable weight for a small glove is 0.252 grams, for a medium glove is 0.276 grams, and for a large glove is 0.30 grams. The particular weight of the material is chosen to provide the protective characteristics required, while insuring that the shell is lightweight and flexible. While the entire outer shell is made from the same material, the stitching in the wristlet 20 is different than the stitching found in the front and back sides 16, 18 of the liner 10. As previously mentioned, the stitching in the wristlet 20 allows for the elastic characteristics desired. The use of the strength material in the outer shell provides protection to the heat resistant inner shell, thereby preventing the inner shell from being damaged by sharp objects or the like and maintaining the integrity of the temperature and flame resistant characteristics.

The inner shell 30 and the outer shell 32 can be bound together using many commonly known methods, including various adhesives. However, in the embodiment shown, the inner and outer shells are bound together by stitching the inner shell to the outer shell. As is shown in FIG. 1, stitching follows the silhouette of the liner, as indicated by 34. Stitching 36 is also randomly positioned about the liner 10 to ensure that the inner and outer shells 30, 32 are maintained in position relative to each other. The stitching is done using NOMEX material, as it is more important to maintain the integrity of the temperature and flame resistant characteristics. With the liner 10 properly assembled, the shells provide the heat resistant and cut resistant characteristics required by fire fighters. However, the liner is not designed to be waterproof, it is designed to be porous. As the liner is always used with an outer glove, it is not necessary for the liner to be water resistant. In fact, if the liner were waterproof or water resistant, the liner would not provide the same safety advantage, as will be more fully discussed below.

In use, firefighters generally put on their gloves prior to putting on their other gear. This is done to prevent their hands from sweating. If the firefighters hands are wet when the glove is put on, the moisture will be trapped inside the glove. The moisture will turn to steam when the fire fighter is exposed to high temperatures, thereby causing the burns on the hands of the fire fighter. Therefore, in order to prevent this problem, fire fighters put on gloves first. However, gloves currently available in the industry are bulky, causing the fire fighters to lose some of their agility in their hands. This loss of agility makes is harder to get dressed in a timely fashion. The liner of the present invention solves this problem. As the liner 10 is light weight and flexible, the fire fighters can put the liners on first without any loss of agility in their hands. Consequently, the hands stay dry and the risk of steam burns is minimized. The lightweight construction of the liners also allows the fire fighters to be more mobile in the field. As the liners provide adequate thermal and mechanical protection, the fire fighters gloves can be more flexible and less bulky, as the gloves do not have to provide the protection previously required. Therefore, the use of the liners allows the fire fighters overall hand protection to be less bulky thereby enabling the fire fighter to maintain more agility in their hands.

The use of the liner also provides a major safety advantage to the fire fighters. As no glove or liner can be one hundred percent effective in all conditions, it is anticipated that the hands of fire fighters will be burned on occasion. This possibility is increased due to the fact that various fire fighters improperly use the gloves or liners. In such cases where burns occur on hands, it is standard procedure, if the fire fighter is wearing standard gloves, to pull off the gloves and place the hands in a solution of saline and water (or some other appropriate medical solution). If the traditional gloves are not removed, the immersion of the hands in the solution will prove ineffective, as the gloves will prevent the solution from reaching the hand. However, as the traditional gloves are removed, it is possible and likely that the skin of the hands will be pulled off with the glove, as the gloves have "melted" to the skin because of the extreme heat. This can create serious complications for the fire fighter. The use of the liner 10 eliminates this problem. As the glove and liner are separate, the glove does not contact the skin and will not "melt" onto the skin under extreme temperature conditions. Therefore, the glove can be removed without damaging the skin of the hand. Once the glove is removed, the liner 10 remains on the hand. The liner 10 is designed to remain on the hand under these conditions. Due to the liners construction, the liner and hand can be submersed in the solution. The liner will allow the solution to reach the hand and treatment necessary until the fire fighter is transported to the hospital where appropriate medical treatment can be given. Consequently, the use of the liner will minimize the harm to the fire fighter even in instances where the liner was effective to prevent the hand of the fire fighter from burning.

While the above description relates to the use of the glove liners in the fire fighting industry, the use of the glove liners can be used in any industry in which the user's hands are exposed to the type of harsh environmental conditions described above. The foregoing illustrates just some of the possibilities for practicing the invention. Many other embodiments are possible within the scope and spirit of the invention. It is therefore intended that the foregoing description be regarded as illustrative rather than limiting, and that the scope of the invention is given by the appended claims together with their full range of equivalents.

What is claimed is:

1. A glove liner for use in harsh environments comprising:

an inner shell made of a temperature resistant and flame resistant material to protect a user's hand from burns, the inner shell is made of a temperature resistant aromatic polyanilde fiber, the fiber of the inner shell has a total weight of under 0.264 grams;

an outer shell made of a puncture resistant and cut resistant material to protect the user's hand and inner shell from damage due to sharp objects; and the inner shell and outer shell are porous to allow a medical liquid solution to pass from outside the outer shell through the inner shell to the user's hand when the glove liner and user's hand are submersed in the medical liquid solution.

2. The glove liner as recited in claim 1 wherein the inner shell and outer shell are bound together.

3. The glove liner as recited in claim 2 wherein the inner shell and outer shell are bound together by stitching the inner shell to the outer shell, the material used for the stitching is the same material used for the inner shell, thereby maintaining the temperature resistant and flame resistant properties of the glove liner.

4. The glove liner as recited in claim 1 wherein a front side and a back side of the glove liner are mirror images of each other, whereby the glove liner can be worn on either of the user's hands.

5. A glove liner for use in harsh environments comprising:

an inner shell made of a temperature resistant and flame resistant material to protect a user's hand from burns;

an outer shell made of a puncture resistant and cut resistant material to protect the user's hand and inner shell from damage due to sharp objects, the outer shell is made of a cut and puncture resistant aromatic polyamide fiber, the fiber of the outer shell has a total weight of less than 0.30 grams; and the inner shell and outer shell are porous to allow a medical liquid solution to pass from outside the outer shell through the inner shell to the user's hand when the glove liner and user's hand are submersed in the medical liquid solution.

6. The glove liner as recited in claim 5 wherein the inner shell and outer shell are bound together.

7. The glove liner as recited in claim 6 wherein the inner shell and outer shell are bound together by stitching the inner shell to the outer shell, the material used for the stitching is the same material used for the inner shell, thereby maintaining the temperature resistant and flame resistant properties of the glove liner.

8. The glove liner as recited in claim 5 wherein a front side and a back side of the glove liner are mirror images of each other, whereby the glove liner can be worn on either of the user's hands.

9. A glove liner for use in harsh environments comprising:

an inner shell made of a temperature resistant and flame resistant material to protect a user's hand from burns;

an outer shell made of a puncture resistant and cut resistant material to protect the user's hand and inner shell from damage due to sharp objects; and the inner shell is made from a lightweight and flexible material having a total weight of less than 0.264 grams and the outer shell is made from a lightweight and flexible material having a total weight of less than 0.30 grams;

whereby the lightweight and flexible material of the glove liner allows the user to maintain flexibility and agility in the user's hands.

10. The glove liner as recited in claim 9 wherein the inner shell is made of a temperature resistant aromatic polyamide fiber.

11. The glove liner as recited in claim 9 wherein the outer shell is made of a cut and puncture resistant aromatic polyamide fiber.

12. The glove liner as recited in claim 9 wherein the inner shell and outer shell are bound together by stitching the inner shell to the outer shell, the material used for the stitching is the same material used for the inner shell, thereby maintaining the temperature resistant and flame resistant properties of the glove liner.

13. The glove liner as recited in claim 9 wherein a front side and a back side of the glove liner are mirror images of each other, whereby the glove liner can be worn on either of the user's hands.

* * * * *

UNITED STATES PATENT AND TRADEMARK OFFICE

CERTIFICATE OF CORRECTION

PATENT NO. : 6,594,830 B2
DATED : July 22, 2003
INVENTOR(S) : Tony Geng

It is certified that error appears in the above-identified patent and that said Letters Patent is hereby corrected as shown below:

Column 4,
Line 52, "polyanilde" should read -- polyamide --.

Signed and Sealed this

Thirtieth Day of September, 2003

JAMES E. ROGAN
*Director of the United States Patent and Trademark Office*